US011730186B2

(12) United States Patent
Mironov

(10) Patent No.: US 11,730,186 B2
(45) Date of Patent: Aug. 22, 2023

(54) HYBRID AEROSOL-GENERATING ELEMENT AND METHOD FOR MANUFACTURING A HYBRID AEROSOL-GENERATING ELEMENT

(71) Applicant: PHILIP MORRIS PRODUCTS S.A., Neuchatel (CH)

(72) Inventor: Oleg Mironov, Cudrefin (CH)

(73) Assignee: Philip Morris Products S.A., Neuchatel (CH)

( * ) Notice: Subject to any disclaimer, the term of this patent is extended or adjusted under 35 U.S.C. 154(b) by 103 days.

(21) Appl. No.: 16/091,777

(22) PCT Filed: Apr. 19, 2017

(86) PCT No.: PCT/EP2017/059217
§ 371 (c)(1),
(2) Date: Oct. 5, 2018

(87) PCT Pub. No.: WO2017/182485
PCT Pub. Date: Oct. 26, 2017

(65) Prior Publication Data

US 2019/0098927 A1 Apr. 4, 2019

(30) Foreign Application Priority Data

Apr. 20, 2016 (EP) ..... 16166107

(51) Int. Cl.
*A24F 40/10* (2020.01)
*A24F 40/20* (2020.01)
(Continued)

(52) U.S. Cl.
CPC ..... *A24B 15/167* (2016.11); *A24C 5/01* (2020.01); *A24D 1/002* (2013.01); *A24D 1/20* (2020.01);
(Continued)

(58) Field of Classification Search
CPC ..... A24D 1/14; A24B 15/167
(Continued)

(56) References Cited

U.S. PATENT DOCUMENTS 2,998,012 A * 8/1961 Lamm ..... A24D 1/02 131/349
3,110,315 A * 11/1963 Lendvai ..... A24B 15/30 131/342
(Continued)

FOREIGN PATENT DOCUMENTS

CA 2781198 6/2011
CN 1151739 C 6/2004
(Continued)

OTHER PUBLICATIONS

PCT International Search Report and Written Opinion for PCT/EP2017/059217 dated Sep. 13, 2017 (16 pages).
(Continued)

*Primary Examiner* — Russell E Sparks
(74) *Attorney, Agent, or Firm* — Mueting Raasch Group

(57) ABSTRACT

The hybrid aerosol-generating element for use in an aerosol-generating article includes a liquid retention material for holding an aerosol-forming liquid and a solid aerosol-forming substrate arranged next to the liquid retention material. The liquid retention material may entirely surround the solid aerosol-forming substrate. An aerosol-generating system utilizes the hybrid aerosol-generating element.

19 Claims, 1 Drawing Sheet

(51) Int. Cl.

| | |
|---|---|
| ***A24F 40/465*** | (2020.01) |
| ***A24B 15/167*** | (2020.01) |
| ***A24C 5/01*** | (2020.01) |
| ***A24D 1/20*** | (2020.01) |
| ***A24F 40/50*** | (2020.01) |
| ***A24D 1/00*** | (2020.01) |

(52) U.S. Cl.
CPC ..... *A24F 40/465* (2020.01); *A24F 40/50* (2020.01); *A24F 40/10* (2020.01); *A24F 40/20* (2020.01)

(58) Field of Classification Search
USPC ..... 131/118
See application file for complete search history.

(56) References Cited

U.S. PATENT DOCUMENTS

| | | | | |
|---|---|---|---|---|
| 4,658,838 | A * | 4/1987 | Leonard | A24D 3/041 131/338 |
| 4,813,437 | A * | 3/1989 | Ray | A24F 42/20 131/273 |
| 4,836,224 | A * | 6/1989 | Lawson | A24D 1/00 131/365 |
| 5,770,747 | A | 6/1998 | Lingelbach | |
| 6,053,176 | A * | 4/2000 | Adams | A24F 47/008 128/202.21 |
| 8,573,230 | B2 * | 11/2013 | Zhuang | A24D 1/00 131/342 |
| 9,510,624 | B2 * | 12/2016 | Li | A24F 40/485 |
| 9,936,727 | B2 * | 4/2018 | Polloni | A24D 1/02 |
| 10,039,890 | B2 * | 8/2018 | Chida | A24B 15/285 |
| 10,201,185 | B2 * | 2/2019 | Bleloch | A24F 40/465 |
| 10,757,976 | B2 * | 9/2020 | Mironov | H05B 3/141 |
| 10,856,575 | B2 * | 12/2020 | Gill | A24F 40/485 |
| 11,185,110 | B2 * | 11/2021 | Fraser | A24F 40/465 |
| 2006/0144412 | A1 * | 7/2006 | Mishra | A24B 15/283 131/337 |
| 2013/0167853 | A1 | 7/2013 | Liu | |
| 2014/0299125 | A1 | 10/2014 | Buchberger | |
| 2014/0338686 | A1 * | 11/2014 | Plojoux | A24F 40/485 131/329 |
| 2015/0027455 | A1 | 1/2015 | Peleg | |
| 2015/0038576 | A1 * | 2/2015 | Timokhina | A61K 31/11 514/470 |
| 2017/0055581 | A1 * | 3/2017 | Wilke | A24D 1/20 |
| 2017/0055582 | A1 * | 3/2017 | Blandino | A24D 1/20 |
| 2017/0064995 | A1 * | 3/2017 | Beeson | A24D 1/002 |
| 2017/0245552 | A1 * | 8/2017 | Reevell | A24F 40/51 |
| 2021/0022406 | A1 * | 1/2021 | Minami | A24F 40/05 |

FOREIGN PATENT DOCUMENTS

| | | | |
|---|---|---|---|
| CN | 203 952 405 | 11/2014 | |
| CN | 204466914 U | 7/2015 | |
| EP | 0703735 | 7/2001 | |
| WO | WO 95/27411 | 10/1995 | |
| WO | WO 2012/164009 | 12/2012 | |
| WO | WO 2013/178769 | 12/2013 | |
| WO | WO-2014102091 A1 * | 7/2014 | H05B 3/0014 |
| WO | WO 2014/139609 | 9/2014 | |
| WO | WO 2015/117704 | 8/2015 | |

OTHER PUBLICATIONS

Office Action issued in Russia for Application No. 2018140674/03 dated Jul. 17, 2020 (16 pages). English translation included.
Office Action issued in China for Application No. 201780024068.5 dated Jan. 29, 2021 (19 pages). English translation included.

* cited by examiner

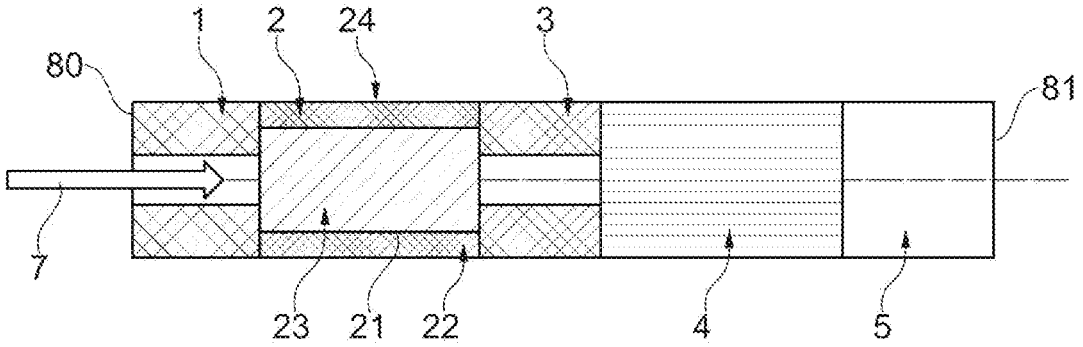
Fig. 1
Fig. 2A
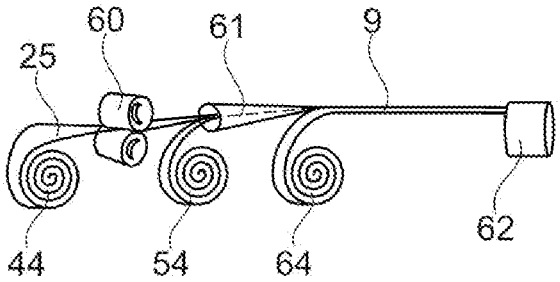
Fig. 2B
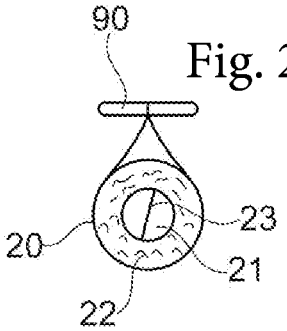
Fig. 2C
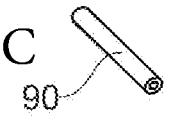
Fig. 2D
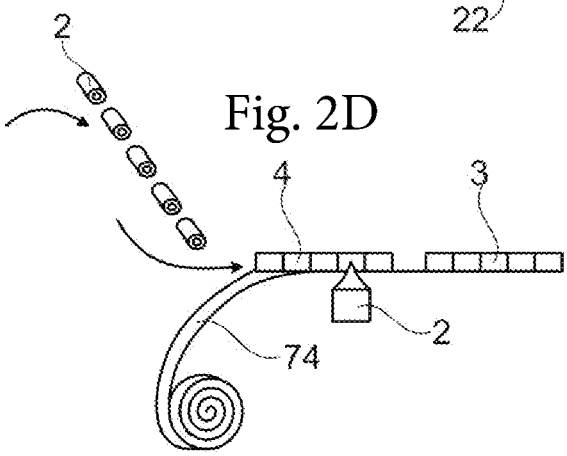

HYBRID AEROSOL-GENERATING ELEMENT AND METHOD FOR MANUFACTURING A HYBRID AEROSOL-GENERATING ELEMENT

This application is a U.S. National Stage Application of International Application No. PCT/EP2017/059217 filed Apr. 19, 2017, which was published in English on Oct. 26, 2017, as International Publication No. WO 2017/182485 A1. International Application No. PCT/EP2017/059217 claims priority to European Application No. 16166107.9 filed Apr. 20, 2016.

Electronic smoking systems that combine the use of e-liquids with the flavour of heated tobacco are known. However, there is the desire to have a hybrid aerosol-generating element to be used in electronic devices designed for the use of e-cigarettes. There is also the desire to have an efficient method for the manufacture of hybrid aerosol-generating elements, in particular for hybrid aerosol-generating elements used in rod-shaped aerosol-generating articles.

According to the invention, there is provided a hybrid aerosol-generating element for use in an aerosol-generating article, for example an e-cigarette. The hybrid aerosol-generating element comprises a liquid retention material for holding an aerosol-forming liquid and comprises a solid aerosol-forming substrate arranged next to the liquid retention material. Preferably, the solid aerosol-forming substrate is a solid aerosol-forming tobacco containing substrate.

In such a hybrid element a user not only gets the flavour or smoking experience of the heated solid aerosol-forming substrate or only the flavour or smoking experience of the heated aerosol-forming liquid, but the combination of the aerosol formed by heating the solid aerosol-forming substrate and the aerosol formed by evaporated aerosol-forming liquid. In such a hybrid element, an aerosol-forming liquid contained in the liquid retention material may for example continually flow or be drawn into the solid aerosol-forming substrate. By this, only the solid aerosol-forming substrate or regions of the solid substrate must be heated, which may reduce energy required in an aerosol-generating system. Yet further, the provision of aerosol-forming liquid may significantly extend a consuming experience of an aerosol-generating element or of an aerosol-generating article comprising such an element. For example, a single tobacco substrate plug as used in aerosol-generating articles may provide aerosol for a couple of puffs, such as for example 5 to 10 puffs. The provision of the liquid retention material with its capability of holding a certain amount of aerosol-forming liquid may extend a consuming experience up to several tenths of puffs, for example, to about 50 to 100 puffs.

While the solid aerosol-forming substrate is preferably provided for delivering a tobacco flavour to an aerosol delivered to a user, the aerosol-forming liquid is preferably used to provide nicotine or non-tobacco flavours to the aerosol generated in a corresponding device using the hybrid aerosol-generating element.

The liquid retention material may hold a predetermined amount of aerosol-forming liquid. The predetermined amount of liquid preferably corresponds to predefined number of puffs to be available when using the hybrid aerosol-generating element.

The hybrid aerosol-generating element has a longitudinal axis and an extension of the element may be larger in the longitudinal direction than in a direction perpendicular to the longitudinal direction. The hybrid aerosol-generating element may for example be cylindrical or substantially cylindrical in shape. The aerosol-generating element may be substantially elongate.

The aerosol-generating element may have a length between 8 and 14 millimeter, for example 10 mm or 12 mm. The diameter of the aerosol-generating element may be between 5 millimeter and 12 millimeter, for example about 8 millimeter.

In the hybrid aerosol-generating element, the liquid retention material and the solid aerosol-forming substrate may be arranged next to each other and subsequently along the longitudinal axis of the element.

Alternatively, the liquid retention material and the solid aerosol-forming substrate may be arranged at least partially at a same longitudinal position of the hybrid aerosol-generating element. In such embodiments the liquid retention material and the solid aerosol-forming substrate are arranged laterally next to each other at least partially over a length of the hybrid aerosol-generating element. The liquid retention material and the solid aerosol-forming substrate may be arranged at a same longitudinal position over an entire length of the hybrid aerosol-generating element. Preferably, the liquid retention material and the solid aerosol-forming substrate are arranged parallel to each other, preferably over the entire length of the element.

The liquid retention material may at least partially surround the solid aerosol-forming substrate. The liquid retention material may entirely surround the solid aerosol-forming substrate in a longitudinal direction. For example, the solid aerosol-forming substrate may be a solid cylindrically shaped aerosol-forming substrate arranged within a tubular shaped liquid retention material.

The hybrid aerosol-generating element may comprise a liquid impervious wrapper, wrapping the hybrid aerosol-generating element. The liquid impervious wrapper may prevent a liquid in the liquid retention material to seep out of the retention material in a direction other than the solid aerosol-forming substrate, for example opposite the solid aerosol-forming substrate or out of the aerosol-generating element.

For aerosol generation, the hybrid aerosol-generating element may be heated by any kind of heating element suitable for and, for example, known from aerosol-generating systems. For example, the hybrid aerosol-generating element may be used in inductively or resistively heated aerosol-generating systems or devices. Accordingly, an aerosol-generating device may be provided with one or more resistively heatable heating elements or with one or more inductively heatable heating elements. If used in inductively heated systems, the heated portion of the heating element may be incorporated into the hybrid aerosol-generating element. The hybrid aerosol-generating element may comprise a susceptor material for inductively heating at least portions of the element. The susceptor material may be arranged within the solid aerosol-forming substrate. The susceptor material may be introduced into the solid aerosol-forming substrate before, during or after manufacturing the hybrid aerosol-generating element.

The liquid retention material is a high retention or high release material (HRM) storing the liquid. Liquid retention material reduces the risk of spill, for example compared to cartridges or tank systems. In case of failure or cracks of the housing of a tank or cartridge spilled liquid could lead to unintended contact with active electrical components and biological tissue. The liquid retention material will intrinsically retain at least a portion of the liquid, which in turn is not available for aerosolization before having left the retention material.

The liquid retention material may be substantially cylindrical in shape. The liquid retention material may have the form of a hollow cylinder. The liquid retention material may be substantially elongate. The liquid retention material may have a length and an (outer) diameter corresponding to the length and diameter of the hybrid aerosol-generating element.

Aerosol-forming liquid to be stored in the retention material may comprise at least one aerosol former and a liquid additive. The aerosol-former may, for example, be propylene glycol or glycerol.

The aerosol-forming liquid may comprise water.

The liquid additive may be any one or a combination of a liquid flavour or liquid stimulating substance. Liquid flavour may for example comprise tobacco flavour, tobacco extract, fruit flavour or coffee flavour. The liquid additive may, for example, be a sweet liquid such as for example vanilla, caramel and cocoa, a herbal liquid, a spicy liquid, or a stimulating liquid containing, for example, caffeine, taurine, nicotine or other stimulating agents known for use in the food industry.

The solid aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

The aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The aerosol-forming substrate may be in loose form, or may be provided in a suitable container or cartridge. For example, the aerosol-forming material of the aerosol-forming substrate may be contained within a paper or other outer wrapper and have the form of a plug.

Optionally, the aerosol-forming substrate may contain additional tobacco or non-tobacco volatile flavour compounds, to be released upon heating of the aerosol-forming substrate. The solid aerosol-forming substrate may also contain capsules that, for example, include the additional tobacco or non-tobacco volatile flavour compounds and such capsules may melt during heating of the solid aerosol-forming substrate.

The aerosol-forming substrate may comprise one or more sheets of homogenised tobacco material that has been gathered into a rod and cut to provide individual plugs of aerosol-forming substrate. Into this or these gathered, rod-shaped sheets a susceptor material may be introduced before, during or after gathering the sheet into a rod. Preferably, the aerosol-forming substrate comprises a crimped and gathered sheet of homogenised tobacco material.

The solid aerosol-forming substrate may be substantially cylindrical in shape. The aerosol-forming substrate may be substantially elongate. The solid aerosol-forming substrate may have a length corresponding to the length of the hybrid aerosol-generating element. The diameter of the aerosol-forming substrate may be between 3 millimeter and 7 millimeter, for example 5.6 mm.

Tobacco containing slurry and a tobacco sheet forming the aerosol-forming substrate made from the tobacco containing slurry comprises tobacco particles, fiber particles, aerosol former, binder and for example also flavours.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

Tobacco particles may be of the form of a tobacco dust having particles in the order of 30 micrometers to 250 micrometers, preferably in the order of 30 micrometers to 80 micrometers or 100 micrometers to 250 micrometers, depending on a desired sheet thickness and casting gap, where the casting gap typically defines the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the sheet versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry for forming the cast leaf may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerol and water to take advantage of the triacetin's ability to convey active components and the humectant properties of the glycerol.

Aerosol formers may be selected from the polyols, glycol ethers, polyol ester, esters, and fatty acids and may comprise one or more of the following compounds: glycerol, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The solid aerosol-forming substrate or the aerosol-forming slurry forming the substrate may contain waxes or fats, which waxes or fats are added for a low temperature release of aerosol-forming substances from the solid aerosol-forming substrate. Some waxes and fats are known for their ability to lower the temperature where an aerosol former is released from a solid substrate containing said waxes or fats.

Preferably, tobacco containing slurry comprises homogenized tobacco material and comprises glycerol or propylene glycol as aerosol former. Preferably, the aerosol-forming substrate is made of a tobacco containing slurry as described above.

Preferably, the solid aerosol-forming substrate has a capillary effect for liquids. Preferably, the solid aerosol-forming substrate provides a capillary effect for aerosol-forming liquid retained in the liquid retention material. Preferably, the solid aerosol-forming substrate enables aerosol-forming liquid to be transported from the liquid retention material into the solid aerosol-forming substrate. The solid aerosol-forming substrate thus consists of or comprises capillary material such that the aerosol-forming liquid is transferred by a capillary effect.

A capillary material is a material that actively conveys liquid from one part of the material to another. The capillary material is advantageously oriented in the solid aerosol-forming substrate to convey aerosol-forming liquid into the solid aerosol-forming substrate.

The solid aerosol-forming substrate may have a fibrous structure or may have a spongy structure. The solid aerosol-forming substrate may comprise a bundle of capillaries, a plurality of fibres, a plurality of threads, or may comprise fine bore tubes. The solid aerosol-forming substrate may comprise a combination of fibres, threads and fine-bore tubes. The fibres, threads and fine-bore tubes may be generally aligned to convey liquid into the solid aerosol-forming substrate. The solid aerosol-forming substrate may comprise sponge-like material or may comprise foam-like material. The structure of the solid aerosol-forming substrate may form a plurality of small bores or tubes, through which the liquid can be transported by capillary action. The capillary effect may be such that liquid is transported to the location of a susceptor or another heating element arranged in the solid aerosol-forming substrate, for example to a center of the substrate.

Susceptor material that may be used in the hybrid aerosol-generating element, in particular that may be incorporated into the solid aerosol-forming substrate may be a plurality of susceptor particles, such as susceptor granules or susceptor flakes.

The susceptor particles may be homogenously distributed in the hybrid aerosol-generating element, preferably in the solid aerosol-forming substrate. The susceptor particles may also be localized in a specific region of the hybrid aerosol-generating element, in particular in a specific region of the solid aerosol-forming substrate.

The susceptor material may be an elongate susceptor arranged longitudinally in the hybrid aerosol-generating element, in particular within the solid aerosol-forming substrate. Preferably, such an elongate susceptor is arranged radially centrally within the hybrid aerosol-generating element, preferably radially centrally within the solid aerosol-forming substrate.

An elongate susceptor has a length dimension that is greater than its width dimension or its thickness dimension, for example greater than twice its width dimension or its thickness dimension. The elongate susceptor is arranged substantially longitudinally within the element. This means that the length dimension of the elongate susceptor is arranged to be approximately parallel to the longitudinal direction of the element, for example within plus or minus 10 degrees of parallel to the longitudinal direction of the element. In preferred embodiments, wherein the elongate susceptor is positioned in a radially central position within the element, it extends along the longitudinal axis of the hybrid aerosol-generating element.

The elongate susceptor is preferably in the form of a pin, rod, strip or blade. The elongate susceptor preferably has a length of between 5 millimeter and 15 millimeter, for example, between 6 mm and 12 mm, or between 8 mm and 10 mm. A lateral extension of a susceptor material may, for example, be between 0.5 mm and 8 mm, preferably between 1 mm and 6 mm, for example 4 millimeter. The elongate susceptor preferably has a width of between 1 mm and 5 mm and may have a thickness of between 0.01 mm and 2 mm, for example between 0.5 mm and 2 mm. In a preferred embodiment the elongate susceptor may have a thickness of between 10 micrometer and 500 micrometer, or even more preferably between 10 and 100 micrometer. If the elongate susceptor has a constant cross-section, for example a circular cross-section, it has a preferable width or diameter of between 1 millimeter and 5 millimeter. If the elongate susceptor has the form of a strip or blade, for example, if the susceptor is made of a sheet-like susceptor material, the strip or blade preferably has a rectangular shape having a width preferably between 2 millimeter and 8 millimeter, more preferably, between 3 mm and 5 mm, for example 4 mm, and a thickness preferably between 0.03 millimeter and 0.15 millimeter, more preferably between 0.05 mm and 0.09 mm, for example 0.07 mm.

Preferably, the elongate susceptor has a length which is the same or shorter than the length of the hybrid aerosol-generating element or of the solid aerosol-forming substrate. Preferably, the elongate susceptor has a same length as the aerosol-generating element or as the solid aerosol-forming substrate.

As used herein, the term 'susceptor' refers to a material that can convert electromagnetic energy into heat. When located within a fluctuating electromagnetic field, typically eddy currents are induced and hysteresis losses occur in the susceptor causing heating of the susceptor. As the susceptor material is in direct physical and thermal contact with the aerosol-forming substrate or the aerosol-forming liquid or both, the aerosol-forming substrate or liquid is heated by the susceptor material.

The susceptor may be formed from any material that can be inductively heated to a temperature sufficient to generate an aerosol from the solid aerosol-forming substrate and the aerosol-forming liquid. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor such as material type, length, width, and thickness may all be altered to provide a desired power dissipation within a known electromagnetic field.

Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be a multi-material susceptor and may comprise a first susceptor material and a second susceptor material. The first susceptor material is disposed in intimate physical contact with the second susceptor material. The first susceptor material is preferably used primarily to heat the susceptor when the susceptor is placed in a fluctuating electromagnetic field. For example the first susceptor material may be aluminium, or may be a ferrous material such as a stainless steel. The second susceptor material is preferably used primarily to indicate when the susceptor has reached a specific temperature, that temperature possibly being the Curie temperature of the second susceptor material. The Curie temperature of the second susceptor material can be used to regulate the temperature of the entire susceptor during operation. Thus, the Curie temperature of the second susceptor material should be below the ignition point of the solid aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and temperature control of the heating may be separated. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate. The second Curie temperature of the second susceptor material may, for example, be selected such that, upon being heated by a susceptor that is at a temperature equal to the second Curie temperature, an overall average temperature of the aerosol-generating element does not exceed 240° C.

Alternatively or in addition, for the control of a heating process of the hybrid aerosol-generating element, also the evaporation temperature of the aerosol-forming liquid may be used as will be outlined in more detail below.

According to the invention, there is also provided a hybrid aerosol-generating article comprising a plurality of elements assembled in the form of a rod. The rod has a mouth end and a distal end upstream from the mouth end. The plurality of elements comprises a hybrid aerosol-generating element according to the invention and as described herein. Advantages and features of the aerosol-generating article relating to the hybrid aerosol-generating element have been described relating to the hybrid aerosol-generating element and will not be repeated.

The plurality of elements may comprise at least one sealing element arranged in an end-to-end relationship with the hybrid aerosol-generating element. The at least one sealing element seals at least a portion of the distal end of the hybrid aerosol-generating element. Preferably, the at least one sealing element seals that portion of the distal end of the aerosol-generating element that comprises the liquid retention material. By this, the at least one sealing element prevents liquid to leave the liquid retention material in a longitudinal upstream direction of the aerosol-generating article.

The plurality of elements may comprise another sealing element, wherein the other sealing element is arranged immediately downstream of the hybrid aerosol-generating element.

The other sealing element seals at least a portion of the proximal end of the hybrid aerosol-generating element. Preferably, the other sealing element seals that portion of the proximal end of the aerosol-generating element that comprises the liquid retention material. By this, the other sealing element prevents liquid to leave the liquid retention material in a longitudinal downstream direction of the aerosol-generating article.

The plurality of elements may comprise two sealing elements, wherein one sealing element is arranged upstream of the hybrid aerosol-generating element and the second sealing element is arranged downstream of the hybrid aerosol-generating element. Preferably, the two sealing elements are arranged directly adjacent the hybrid aerosol-generating element.

In some embodiments, the at least one sealing element may prevent a susceptor arranged in the aerosol-generating element to be displaced or to fall out of the aerosol-generating element upon transport or handling of the article.

The at least one sealing element may be a hollow sealing element. All sealing elements may be hollow sealing elements. A hollow sealing element may seal a distal or also proximal end of a hollow tubular-shaped retention material and allows to pass air or in the case of the downstream arranged sealing element, to pass aerosol through the sealing element. Preferably, sealing elements do not alter a resistance to draw of the aerosol-generating article.

The sealing element may be made of any material suitable for use in an aerosol-generating article. The sealing element may, for example, be made of a same material as used in a conventional mouthpiece filter, in an aerosol-cooling element or in a support element. Exemplary materials are filter materials, ceramic, polymeric material, cellulose acetate, cardboard, non-inductively heatable metal, or zeolite.

Preferably, the sealing element is made of a heat resistant material. Heat resistant material for the sealing element is herein meant that the sealing element may resist temperatures of up to about 350 degree Celsius. Advantageously, the sealing element is not affected by the heated aerosol-generating element or a potential heating element arranged in the aerosol-generating element.

Preferably, the sealing element does not change its consistency, geometry or optics upon use of the article.

Preferably, the sealing element does not generate additional substances to the generated aerosol during use of the article.

The sealing element has a (external) diameter that is approximately equal to a diameter of the aerosol-generating article. The sealing element has a length that may be defined as the dimension along the longitudinal axis of the aerosol-generating article. The length of the sealing element may be between 1 millimeter and 10 millimeter, for example between 4 mm and 8 mm or between 5 mm and 7 mm. It is preferred that the sealing element is substantially cylindrical. Preferably, a sealing element is smaller than 8 mm. Preferably, the sealing element has a length of at least 2 millimeter in order to facilitate assembly of an aerosol-generating article, preferably at least 3 millimeter or at least 5 millimeter.

The minimum sizes of the length of the sealing element facilitate or allow use of conventional combiners to assemble the plurality of elements to a rod shape.

As a general rule, whenever a value is mentioned throughout this application, this is to be understood such that the value is explicitly disclosed. However, a value is also to be understood as not having to be exactly the particular value due to technical considerations.

The plurality of elements may for example also comprise one or several of the following elements: a mouthpiece element, a support element, or an aerosol-cooling element.

The mouthpiece element may be located at the mouth end or downstream end of the aerosol-generating article.

The mouthpiece element may comprise at least one filter segment. The filter segment may be a cellulose acetate filter plug made of cellulose acetate tow. A filter segment may have low particulate filtration efficiency or very low particulate filtration efficiency. A filter segment may be longitudinally spaced apart from the hybrid aerosol-generating element. The filter segment may have a length between 5 millimeter and 14 millimeter, for example 7 millimeter.

A user contacts the mouthpiece element in order to pass an aerosol generated by the aerosol-generating article through the mouthpiece element to the user. Thus, a mouthpiece element is arranged downstream of a hybrid aerosol-generating element.

The mouthpiece element preferably has an external diameter that is approximately equal to the external diameter of the aerosol-generating article. The mouthpiece element may have a length of between 5 millimeter and 25 millimeter, preferably a length of between 10 mm and 17 mm. In a preferred embodiment, the mouthpiece element has a length of 12 mm or 14 mm. In another preferred embodiment, the mouthpiece element has a length of 7 mm.

A support element may be located immediately downstream of the hybrid aerosol-generating element and may abut the hybrid aerosol-generating element.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube. A sealing element sealing a proximal end of the hybrid aerosol-generating element may be a support element or a support element may be designed as a sealing element, respectively.

The support element preferably has an external diameter that is approximately equal to the external diameter of the aerosol-generating article.

The support element may have a length of between 5 mm and 15 mm. In a preferred embodiment, the support element has a length of 8 mm.

An aerosol-cooling element may be located downstream of the hybrid aerosol-generating element, for example immediately downstream of a support element or a sealing element, and may abut the support element or the sealing element.

As used herein, the term 'aerosol-cooling element' is used to describe an element having a large surface area and a low resistance to draw. In use, an aerosol formed by volatile compounds released from the aerosol-forming substrate is drawn through the aerosol-cooling element before being transported to the mouth end of the aerosol-generating article. In contrast to high resistance-to-draw filters, for example filters formed from bundles of fibers, aerosol-cooling elements have a low resistance to draw. Chambers and cavities within an aerosol-generating article such as expansion chambers and support elements are also not considered to be aerosol cooling elements.

An aerosol-cooling element preferably has a porosity in a longitudinal direction of greater than 50 percent. The airflow path through the aerosol-cooling element is preferably relatively uninhibited. An aerosol-cooling element may be a gathered sheet or a crimped and gathered sheet. An aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of MATER-BI® (a commercially available family of starch based copolyesters).

An aerosol-cooling element preferably comprises a sheet of PLA, more preferably a crimped, gathered sheet of PLA. An aerosol-cooling element may be formed from a sheet having a thickness of between 10 micrometer and 250 micrometer, for example 50 micrometer. An aerosol-cooling element may be formed from a gathered sheet having a width of between 150 millimeter and 250 millimeter. An aerosol-cooling element may have a specific surface area of between 300 millimeter$^2$ per millimeter length and 1000 millimeter$^2$ per millimeter length between 10 millimeter$^2$ per mg weight and 100 millimeter$^2$ per mg weight. In some embodiments, the aerosol-cooling element may be formed from a gathered sheet of material having a specific surface area of about 35 millimeter$^2$ per mg weight. An aerosol-cooling element may have an external diameter of between 5 millimeter and 10 millimeter, for example 7 mm.

The length of the aerosol-cooling element may be between 10 millimeter and 15 millimeter, for example 13 millimeter or may in alternative embodiments be between 15 millimeter and 25 millimeter, preferably between 16 millimeter and 20 millimeter, for example 18 millimeter.

The length of the aerosol-cooling element may even be shorter according to a desired or required cooling effect. For example, waxes or fats for a low temperature release of aerosol-forming substances from the solid aerosol-forming substrate may be contained in the solid substrate. In such embodiments, an aerosol-cooling element may be shortened to a few millimeter, for example 5 to 10 millimeter, or may possibly be omitted.

The plurality of elements of the aerosol-forming article may be circumscribed by an outer wrapper. The outer wrapper may be formed from any suitable material or combination of materials. Preferably, the outer wrapper is a cigarette paper.

According to the invention, there is also provided an aerosol-generating system comprising a hybrid aerosol-generating article according to the invention and as described herein. The system further comprises a heating element for heating at least a portion of the hybrid aerosol-generating element of the hybrid aerosol-generating article, a power source to provide energy to the heating element and a control electronics configured to control a heating of the hybrid aerosol-generating element.

The control electronics may be programmed to determine a temperature of the at least a portion of the hybrid aerosol-generating element, which temperature is used to control the heating of the at least a portion of the hybrid aerosol-generating element.

With resistive heating elements, an ohmic resistance of the heating element may be correlated to the temperature of the heating element. In inductively heated systems, a temperature of a susceptor may be determined from an apparent ohmic resistance ($R_a$) of an inductive "heating circuit". Such an inductive heating circuit and determination of apparent resistance and their correlation with a temperature of the susceptor is described in detail in the international patent publication WO2015/177256.

In the aerosol-generating system, an evaporation temperature of an aerosol-forming liquid provided in the liquid retention material of the aerosol-generating element may be used to control the heating of the hybrid aerosol-generating element or, for example, of the solid aerosol-forming substrate of the element. The evaporation temperature of the aerosol-forming liquid may correspond to a predefined maximum heating temperature.

The aerosol-forming liquid may be heated up to its evaporation temperature, where the liquid is evaporated. As long as aerosol-forming liquid is present, for example in the solid aerosol-generating substrate, said substrate may not be heated above the evaporation temperature of the liquid before all the liquid has been evaporated. As long as liquid may seep into the solid substrate, the solid substrate will not be heated above the evaporation temperature thus the evaporation temperature corresponding to a maximum heating temperature.

The aerosol-generating system may comprise an aerosol-generating device comprising a device housing and a cavity arranged in the device housing. The cavity has an internal surface shaped to accommodate at least a portion of the hybrid aerosol-generating article. The cavity is arranged such that upon accommodation of the at least a portion of the hybrid aerosol-generating article in the cavity the heating element is arranged such that the at least a portion of the hybrid aerosol-generating element is heated during operation of the device.

Preferably, the entire aerosol-generating element of the article is accommodated in the cavity.

In a resistively heated device, a heating element is typically inserted into the aerosol-generating article, or into the aerosol-generating element, respectively.

In an inductively heated device, the cavity is arranged such that upon accommodation of at least the portion of the aerosol-generating element in the cavity an inductor comprised in the device may be inductively coupled to a susceptor arranged in thermal contact with the hybrid aerosol-generating element, for example to a susceptor arranged in the aerosol-generating element, preferably, in the solid aerosol-forming substrate.

According to the invention, there is also provided a method for manufacturing hybrid aerosol-generating elements for use in an aerosol-generating article. The method comprises the steps of providing a continuous solid aerosol-forming substrate and a continuous liquid retention material and guiding the continuous liquid retention material parallel to the continuous solid aerosol-forming substrate. Yet further steps comprise forming the continuous solid aerosol-forming substrate and the continuous liquid retention material into a continuous rod and cutting the continuous rod into individual hybrid aerosol-generating elements.

The continuous retention material may thereby be arranged along one longitudinal side, for example a first half, of the continuous rod and the continuous solid aerosol-forming substrate may be arranged along the other longitudinal side, for example other half, of the continuous rod.

The continuous retention material may also be arranged to at least partially or entirely surround the continuous solid aerosol-forming substrate. In these embodiments, the method preferably comprises the further steps of forming the solid continuous aerosol-forming substrate at least partially into a continuous rod, then arranging the continuous liquid retention material around the at least partially formed continuous rod of solid aerosol-forming substrate, and then forming the continuous liquid retention material arranged around the at least partially formed continuous rod of aerosol-forming substrate into a continuous rod. By this, a continuous rod may be formed having an outer shell of retention material and a core of solid aerosol-forming substrate.

The method may further comprise the step of wrapping the continuous rod with a fluid impervious wrapper before cutting the continuous rod.

A liquid may be present in the continuous retention material before forming a continuous rod or may be provided to the retention material after forming the continuous rod. However, the liquid is provided to the liquid retention material before wrapping the continuous rod with the liquid impervious wrapper.

For manufacturing a hybrid aerosol-generating element for inductive heating applications a susceptor may be incorporated into the element upon manufacturing the element. In these embodiments, the method may further comprise the step of introducing a susceptor material, preferably a continuous susceptor material, into the solid continuous aerosol-forming substrate. Preferably, the susceptor material, for example a band or filament is inserted into the element, preferably into the continuous solid aerosol-forming substrate before forming a rod. Preferably, the susceptor is incorporated into a partially formed continuous rod of solid aerosol-forming substrate.

Preferably, the solid continuous aerosol-forming substrate is provided in the form of a sheet-like continuous substrate.

Preferably, the continuous liquid retention material is provided in the form of a sheet-like continuous web, preferably a porous web.

Hybrid aerosol-generating elements cut from the continuous rod may then be assembled with further elements in an end-to-end position forming a rod. The assembled elements may then be wrapped with an outer wrapper to from the hybrid aerosol-generating article.

The invention is further described with regard to embodiments, which are illustrated by means of the following drawings, wherein:

FIG. 1 is a schematic illustration of a hybrid aerosol-generating article;

FIG. 2A-D are schematic illustrations of a manufacturing method of hybrid aerosol-generating elements and articles comprising a susceptor.

FIG. 1 illustrates an aerosol-generating article. The aerosol-generating article comprises five elements arranged in coaxial alignment: a first sealing element 1, a hybrid aerosol-forming element 2, a second sealing element 3 also acting as support element, an aerosol-cooling element 4, and a mouthpiece 5. Each of these five elements is a substantially cylindrical element, each having substantially the same diameter. The five elements are arranged sequentially and are circumscribed by an outer wrapper (not shown) to form a cylindrical rod.

The first sealing element 1 is located at the extreme distal or upstream end 80 of the aerosol-generating article. The first sealing element 1 is shown as a hollow tube, for example a hollow cellulose acetate tube. The hollow tube allows air to pass through the first sealing element 1 and into the hybrid aerosol-forming element 2 arranged adjacent and downstream of the first sealing element 1. The hollow tube of the first sealing element 1 has an inner diameter, which is smaller than the inner diameter of a liquid retention material tube 22 of the hybrid aerosol-generating substrate element 2. The material of the first sealing element is impervious to a liquid held in the liquid retention material tube 22. Thus, the first sealing element 1 prevents liquid to leave the distal end of the retention material tube 22 in an upstream direction.

The hybrid aerosol-generating element 2 comprises a tobacco plug 21 of a solid aerosol-forming substrate material comprising a gathered sheet of crimped homogenised tobacco material. The crimped sheet of homogenised tobacco material comprises glycerol or propylene glycol as aerosol-former. The tobacco plug 21 may have a diameter of about 5.6 mm.

A susceptor blade 23 is located along a radially central axis of the aerosol-forming element 2. The susceptor has about a same length than the length of the aerosol-forming element 2. The susceptor may be a ferritic iron material having a length of 10 mm to 12 mm, a width of 3 mm and a thickness of 1 mm.

A diameter of the susceptor blade 23 is larger than the inner diameter of the first sealing element 1. Thus, the susceptor blade 23 is prevented from dislodging or falling out of the aerosol-generating element 2 by the first sealing element 1.

The liquid retention material tube 22 is arranged around the tobacco plug 21. The liquid retention material is a porous material, for example a plastics material and adapted to retain an amount of aerosol-forming liquid. The aerosol-forming liquid comprises glycerol or propylene glycol as aerosol-former and nicotine. The thickness of the tube wall of the liquid retention material tube is about 0.8 mm.

The hybrid aerosol-forming element 2 is wrapped by an impervious wrapper 24. The wrapper 24 is impervious to the aerosol-forming liquid in the retention material 22.

The second sealing element 3 or support element is located immediately downstream of the aerosol-forming element and abuts the aerosol-forming element 2. In FIG. 1, the second sealing element 3 is identical to the first sealing element 1. The second sealing element is shown as a hollow tube, for example a hollow cellulose acetate tube.

The second sealing element 3 locates the aerosol-forming element 2 in the aerosol-generating article.

The second sealing element 3 allows evaporated substances from or aerosol formed in the hybrid aerosol-forming element 2 to pass through the second sealing element 3 and further downstream into the aerosol-cooling element 4 arranged adjacent and downstream of the second sealing element 3. The hollow tube of the second sealing element 3 has an inner diameter, which is smaller than the inner diameter of the liquid retention material tube 22 of the hybrid aerosol-generating element 2. The material of the second sealing element 3 is impervious to the liquid held in the liquid retention material tube 22. Thus, the second sealing element 3 prevents liquid to leave the proximal end of the retention material tube 22 in a downstream direction.

Thus, liquid in the retention material 22 may leave the retention material only into the direction of the tobacco plug 21. If the same is heated by the susceptor 23, aerosol-forming substances in the tobacco plug 21 are evaporated and aerosol-forming liquid is drawn from the retention material into the tobacco plug 21.

The second sealing element 3 also acts as a spacer to space the aerosol-cooling element 4 from the aerosol-forming element 2.

The aerosol-cooling element 4 is located immediately downstream of the second sealing element 3 and abuts the second sealing element 3. In use, volatile substances released from the aerosol-forming element 2 pass along the aerosol-cooling element 4 towards the mouth end 81 of the aerosol-generating article. The volatile substances may cool within the aerosol-cooling element 4 to form an aerosol that is inhaled by the user. The aerosol-cooling element comprises a crimped and gathered sheet of polylactic acid circumscribed by a wrapper (not shown). The crimped and gathered sheet of polylactic acid defines a plurality of longitudinal channels that extend along the length of the aerosol-cooling element 4.

The mouthpiece 5 is located immediately downstream of the aerosol-cooling element 4 and abuts the aerosol-cooling element 4. In FIG. 1, the mouthpiece 5 comprises a conventional cellulose acetate tow filter of low filtration efficiency.

To assemble the aerosol-generating article, the five cylindrical elements described above are aligned and tightly wrapped within an outer wrapper. The outer wrapper may be a conventional cigarette paper.

The aerosol-generating article has a proximal or mouth end 81, which a user inserts into his or her mouth during use, and a distal end 80 located at the opposite end of the aerosol-generating article to the mouth end 81. Once assembled, the total length of the aerosol-generating article 10 is about 45 mm to 53 mm and the diameter is about 7.2 mm.

In use air is drawn through the aerosol-generating article as indicated by arrow 7 by a user from the distal end 80 to the mouth end 81. The distal end 80 of the aerosol-generating article may also be described as the upstream end of the aerosol-generating article and the mouth end 81 of the aerosol-generating article may also be described as the downstream end of the aerosol-generating article.

Upon manufacturing the article, the five elements are prepared, assembled and wrapped by the outer wrapper.

The susceptor 23 may be inserted into the tobacco plug 21 prior to the assembly of the plurality of elements to form a rod. Alternatively, all elements except for the first sealing element 1 may be assembled. The susceptor may then be inserted into the distal end of the assembly such that it penetrates the tobacco plug 21.

The aerosol-generating article of FIG. 1 is designed to engage with an electrically-operated aerosol-generating device preferably comprising an induction coil, or inductor, in order to be smoked or consumed by a user.

In FIG. 2A-D embodiments of a manufacturing method for hybrid aerosol-generating substrate elements and articles comprising such elements is illustrated.

Continuous tobacco material 25, for example a sheet of cast leaf is provided on a reel 44. The tobacco sheet 25 is crimped between crimping rollers 60.

Continuous susceptor material 54, for example a susceptor band material, is provided on another reel. The crimped tobacco sheet and the susceptor band 54 are led together into a garniture tongue 61, where a continuous rod is formed comprising the tobacco material enveloping the susceptor band.

The continuous tobacco rod is enveloped by a high retention material 64, for example a web of retention material, which is provided on a further reel. The retention material 64 may contain liquid before being wrapped around the tobacco rod. Liquid may also be provided to the retention material after being wrapped around the tobacco rod.

The continuous rod is additionally provided with a liquid impervious wrapper, which may be provided on yet another reel (not shown). The final continuous rod 9 is cut with a cutter into rod segments 90 or directly into final-length aerosol-generating substrate elements 2. A cross-section 20 through a rod segment 90 or through the aerosol-generating substrate elements 2 is also shown in FIG. 2A-D.

After the continuous rod 9 or the rod segments 90 have been cut into aerosol-generating substrate elements 2, the elements 2 may be provided to an article assembling machine.

Elements of the article are aligned in a row on the outer wrapper 74 together with an aerosol-generating substrate element 2. The elements or segments are then assembled and wrapped with the outer wrapper 74 forming a hybrid aerosol-generating article adapted for being inductively heated.

In the embodiments shown in the figures, susceptor material is described or shown to be arranged within the solid aerosol-forming substrate or tobacco plug, heating the tobacco plug and the liquid that has seeped into the plug. Thereby heating may mainly be limited to the tobacco plug, while the aerosol-forming liquid in the retention material is not or not significantly heated. However, susceptor material may alternatively or additionally be provided in, for example incorporated into, the liquid retention material. By heating the liquid in the retention material, increased delivery of aerosol-forming liquid may be achieved.

The invention claimed is:

1. A hybrid aerosol-generating element for use in an aerosol-generating article, the hybrid aerosol-generating element comprising a liquid retention material holding an aerosol-forming liquid and a solid aerosol-forming substrate in the form of a sheet being a continuous substrate comprising cellulose-containing material, the solid aerosol-forming substrate is arranged next to the liquid retention material, wherein the liquid retention material and the solid aerosol-forming substrate are arranged at least partially at a same longitudinal position of the hybrid aerosol-generating element, wherein the liquid retention material is a tubular element and the solid aerosol-forming substrate is a cylindrical plug element, and wherein the liquid retention material entirely surrounds the solid aerosol-forming substrate, and a liquid impervious wrapper disposed about the liquid retention material, wherein the liquid retention material separates the solid aerosol-forming substrate from the liquid impervious wrapper, and wherein the hybrid aerosol-generating element comprises a susceptor material.

2. The hybrid aerosol-generating element according to claim 1, wherein the liquid retention material holds a predetermined amount of the aerosol-forming liquid.

3. The hybrid aerosol-generating element according to claim 1, wherein the solid aerosol-forming substrate comprises a capillary material in contact with the liquid retention material.

4. The hybrid aerosol-generating element according to claim 3, wherein the capillary material enables the aerosol-forming liquid to be transported into the solid aerosol-forming substrate.

5. The hybrid aerosol-generating element according to claim 1, wherein the cellulose-containing material comprises tobacco-containing material.

6. The hybrid aerosol-generating element according to claim 1, wherein the cellulose-containing material comprises reconstituted tobacco.

7. The hybrid aerosol-generating element according to claim 1, wherein the cellulose-containing material comprises a gathered sheet of homogenised tobacco material.

8. The hybrid aerosol-generating element according to claim 1, wherein the cellulose-containing material comprises tobacco-containing material and an aerosol-former comprising glycerol or propylene glycol.

9. The hybrid aerosol-generating element according to claim 1, wherein the liquid retention material is a continuous material or sheet.

10. The hybrid aerosol-generating element according to claim 3, wherein the capillary material is oriented in the solid aerosol-forming substrate to convey aerosol-forming liquid to a center of the solid aerosol-forming substrate.

11. The hybrid aerosol-generating element according to claim 1, wherein the susceptor material is a continuous susceptor material extending along the entire length of the hybrid aerosol-generating element.

12. A hybrid aerosol-generating article comprising a plurality of elements assembled in the form of a rod, the plurality of elements comprising the hybrid aerosol-generating element according to claim 1.

13. The hybrid aerosol-generating article according to claim 12, wherein the plurality of elements further comprise at least one sealing element arranged in an end-to-end relationship with the hybrid aerosol-generating element, the at least one sealing element sealing at least a portion of a distal end of the hybrid aerosol-generating element.

14. An aerosol-generating system comprising the hybrid aerosol-generating article according to claim 12, further comprising:

a heating element for heating at least a portion of the hybrid aerosol-generating element of the hybrid aerosol-generating article;

a power source to provide energy to the heating element;

control electronics configured to control heating of the hybrid aerosol-generating element.

15. The aerosol-generating system according to claim 14, wherein an evaporation temperature of the aerosol-forming liquid provided in the liquid retention material of the aerosol-generating element corresponds to a predefined maximum heating temperature.

16. The aerosol-generating system according to claim 14, wherein the control electronics are programmed to determine a temperature of the at least a portion of the hybrid aerosol-generating element, which temperature is used to control the heating of the at least a portion of the hybrid aerosol-generating element.

17. A hybrid aerosol-generating article comprising a plurality of elements assembled in the form of a rod, the plurality of elements comprising the hybrid aerosol-generating element according to claim 1 and a cylindrical sealing element arranged in an end-to-end relationship with each other, wherein the liquid retention material entirely surrounds the solid aerosol-forming substrate along a longitudinal direction of the article, and the sealing element sealing at least a portion of a distal end of the hybrid aerosol-generating element thereby preventing the aerosol-forming liquid from leaving the liquid retention material in a longitudinal upstream direction of the aerosol-generating article.

18. The hybrid aerosol-generating article according to claim 17, wherein the sealing element is arranged at a most upstream end of the aerosol-generating article.

19. The hybrid aerosol-generating article according to claim 17, wherein a further cylindrical sealing element is arranged in an end-to-end relationship with the cylindrical hybrid aerosol-generating element and the cylindrical sealing element, wherein the further sealing element is arranged to seal at least a portion of a proximal end of the hybrid aerosol-generating element.

* * * * *